US005810449A

United States Patent [19]

Grathoff

[11] Patent Number: 5,810,449

[45] Date of Patent: Sep. 22, 1998

+

[54] CUTTING DRUM FOR AN OPEN CAST APPARATUS PERFORMING ITS WINNING ACTION IN BOTH DIRECTIONS OF TRAVEL

[75] Inventor: Hartmut Grathoff, Wendelstein, Germany

[73] Assignee: Man Takraf Fördertechnik GmbH, Leipzig, Germany

[21] Appl. No.: 768,772

[22] Filed: Dec. 13, 1996

[30] Foreign Application Priority Data

Dec. 16, 1995 [DE] Germany ..... 195 47 170.9

[51] Int. Cl.[6] ..... E21C 35/18; E02F 3/24

[52] U.S. Cl. ..... 299/39.8; 37/190; 299/85.2

[58] Field of Search ..... 299/39.7, 39.8, 299/80.1, 85.2; 37/189, 190

[56] References Cited

U.S. PATENT DOCUMENTS

| | | | |
|---|---|---|---|
| 4,009,531 | 3/1977 | Metrier | 37/190 X |
| 4,120,106 | 10/1978 | Smith et al. | 37/190 |
| 5,013,093 | 5/1991 | Morrell et al. | 299/85.2 X |
| 5,092,659 | 3/1992 | Grathoff | 299/39.2 |

FOREIGN PATENT DOCUMENTS

| | | | |
|---|---|---|---|
| 1 749 015 | 7/1957 | Germany . | |
| 3106565 | 8/1982 | Germany . | |
| 39 20 011 C3 | 6/1996 | Germany . | |
| 441403 | 5/1975 | U.S.S.R. | 299/85.2 |
| 385033 | 9/1976 | U.S.S.R. | 299/85.2 |

OTHER PUBLICATIONS

*Glückauf* "Die Auslegung von Schneidköpfen für optimale Löseleistungen" (1993) pp. 524–532.

*Primary Examiner*—David J. Bagnell
*Attorney, Agent, or Firm*—McGlew and Tuttle

[57] ABSTRACT

The operative members in open pit mining apparatus, designed as strata cutting and loading machines are exposed to high wear and tear in practical operation. The cutter tools (3) are so designed that those picks (5) which are cutting are in their operating position while the picks (5) for the other working direction are swivelled out of the cutting orbit. They must be robust and always functional. Pick holders armed with picks (5) are therefore pivotally disposed on hinges on both sides in the direction of rotation on the cutter bars (1) arranged on the circumference of the cutting drum. Two pick holders on opposite sides, form a pair. These are interconnected in articulated manner by a bar of such length that one pick (5) can perform its winning action while the other pick (5) is angularly displaced out of the groove being cut. Due to the excavating resistance, the cutter tools (3*a* and 3*b*) automatically assume their operating position. A two-way latch is provided for fixation in either operating position. The so designed cutting drum permits high operational reliability in robust operating conditions.

13 Claims, 6 Drawing Sheets

CUTTING DRUM FOR AN OPEN CAST APPARATUS PERFORMING ITS WINNING ACTION IN BOTH DIRECTIONS OF TRAVEL

BACKGROUND OF THE INVENTION AND PRIOR ART

The invention relates to a cutting drum for an open cast winning apparatus performing its winning action in both directions of travel, automotive on an undercarriage, comprising cutter bars on its periphery, said cutter bars being interconnected in peripheral direction by two rings and holding cutter tools consisting of picks and pick holders, the pick holders including the picks being so pivotally mounted around a pivoting axis that the picks pointing in the direction of rotation, due to the excavation resistance, automatically swivel into the cutting position when engaging the material to be worked, the picks oriented in opposite direction simultaneously swivelling from the angular position of cutting of the picks performing the excavation work.

For underground coal winning a cutting drum comprising pivotal cutting tools consisting of double-edged pick holders according to DE-GM 17 49 015 is known. The pick holders are adapted to swivel around bolts provided in the drum body in parallel relationship to the drum axis. In their end positions the pick holders are fixed by securing means latching into depressions in the bolt.

According to DE 39 20 011 a cutting drum for use in open pit mining is known which consists of a latticed drum base body on the periphery of which cutter bars are provided in axial direction in evenly spaced relationship, interconnected in peripheral direction by rings. On their side forming the drum circumference, the cutter bars support pick holders on which, as in the solution cited above as known state of the art, cutting picks are provided in V-shaped manner in pairs each pivotally in a common joint, parallel to the drum axis. In this context the pick pointing in the direction of rotation, is in working position while the other pick facing away, is automatically swivelled to an angle out of the region of excavation. In the terminal positions the pick holders can be secured by means of spring elements latching into depressions. This known solution, however, still has shortcomings:

- The disposition of the picks with their tips widely spaced from the center of the cutter bar cross-section (neutral fibre) generates large torque in the cutter bar as well as the risk of unacceptable torsional oscillations (rattling).
- The material loosened by the pick tips is carried along by the sheet metal scrapers provided between the pick holders. If ridges remain between the grooves dug by the pick tips when loosening hard material, these are broken loose by the sheet metal scrapers, provided the latter are of a sufficiently strong construction. The large spacing of the outer edges of these sheet metal scrapers from the center of the cutter bar cross-section likewise results in considerable strains. In addition, the central disposition of the sheet metal scrapers of the cutter bar is detrimental to the flow of the material to be mined.
- The pick holders disposed in radial direction outside the cutter bar result in a large radial spacing from the cutting orbit up to the annular chute surface. For a given cutting orbit diameter little volume for construction is left for the structural components within the annular chute.

A need still exists to structurally so design the cutting drum for an open cast winning apparatus performing its winning action in both directions of travel that it is robust and ensures high operational reliability and availability in a simple technical structure while minimizing material expenditure.

GENERAL DESCRIPTION OF THE INVENTION

In accordance with the invention a mining apparatus is provided as set out in the opening paragraph, wherein

- two pick holders, of which the one pick holder is provided for right-hand cutting work and the other pick holder for left-hand cutting work, are disposed in hinged manner in the direction of rotation on opposite sides of a cutter bar in the regions of those of their edges which are directed towards the interior of the cutting drum and, together with sheet metal scrapers connecting the pick holders, form cutting tools, consisting of two or more pairs, said pairs being disposed on both sides of the cutter bars,
- interchangeable picks are attached to the pick holders,
- the sheet metal scrapers are designed as blades in the region of the pick tips,
- connecting bars are provided between the cutting tools, on opposite sides of the cutter bar so arranged that the cutting tools pointing in opposition to the direction of rotation are raised from the cutter bar and swivelled at an angle outside the excavation being cut while the picks pointing in the peripheral direction perform excavation work and are pressed against the cutter bar by the excavation force
- latches are provided on the connecting bars, holding the picks in their excavating position or non-excavating position, as the case may be, with a force sufficiently great to avoid tipping over of the pick holders by their own weight when the cutting drum is rotating and
- when changing the cutting direction, the picks of one cutter bar side are moved in such a manner against the force of the latches due to contact of the picks and blades with the mineral matter to be cut loose that the picks now pointing in the direction of rotation are swivelled into the excavating position and the picks on the opposite side are swivelled into the non-excavating position.

The blades and rear sheet metal plates ensure improved forwarding and a better flow of the loosened material being mined. Coalescing strata may likewise be excavated. Due to the larger support base of the pick holders from the center of the joint to the outer edge of the cutter bar lesser forces arise at the mountings of the pick holders. The torque on the cutter bars is thus reduced. By the disposition of a cutting tool on both sides of a cutter bar, a lower construction height in respect of the cutter bar is attained from the outer diameter of the annular chute towards the cutting orbit.

The picks are provided—in a known manner—on helical lines on the drum circumference, the lead of which is so selected that the groove ripped into the material to be excavated by the pick is followed by a subsequent, laterally displaced groove, which, in relation to the first groove, has a predetermined spacing of about the same order of magnitude as the maximum penetration depth of the pick in which context the groove spacing and the maximum penetration depth of the material to be excavated, depend on the pick geometry and the desired particle size of the loosened material.

The aforementioned German patent DE 39 200 11 and corresponding patents in other countries, e.g. U.S. Pat. No. 5,092,659 which by cross reference is to form part of the present disclosure, discloses constructions wherein, because of high torque and bending loads the cutter bars are interconnected in circumferential direction by a plurality of rings. In accordance with preferred embodiments of the present invention these rings (shown as items 5 in FIGS. 4 and 9 of these prior art disclosures of the present applicant and inventor) are replaced by bars which—connected to the cutter bar in a manner resistant to bending—are provided on helical lines having the same lead as the helical lines connecting the pick tips. Exterior and interior outlines of the bars approximately match those of the cutter bars.

According to the invention, cutting tools each comprising two or more picks and pick holders, and blades are provided between the bars.

The picks, as known per se, are disposed obliquely by a few degrees to the peripheral direction so that they rotate around their longitudinal axes when in operation, thereby sharpening themselves.

The cutter bars may be disposed in axial direction or obliquely on the circumference of the cutting roller or in a herringbone pattern. Preferably the cutter bars are connected by connecting bars, disposed approximately in peripheral direction and the inward and outward outlines of which approximately match those of the cutter bars.

The bars connecting the cutter bars distribute the bending loads acting in peripheral direction of a cutter bar to the adjoining cutter bar, further transforming a greater part of torque of the cutter bars into bending loads in radial direction, thus utilizing the rigidity of the cutter bars in both directions (radial and tangential).

Advantageously the cutters are distributed on helical lines over the circumference of the cutting drum. Preferably the connecting bars are likewise disposed on helical lines, the said helical lines of the connecting bars being disposed approximately halfway between two adjoining helical lines of the cutters. The picks may, for example be round picks, flat picks or spade picks. Preferably the rear of a pick holder is so designed that in operation position it touches the cutter bar only on a small contact surface and that this contact surface is spaced as far from the hinge as possible. Advantageously the cutting tools consisting of pick holders, picks and blades, find support against the cutter bars merely with the rear of the blades. According to preferred embodiments the outermost pick holders disposed in the region of the end faces of the drum are deflected at right angles in such a manner that their picks cut free a cylindrical outline, projecting beyond the end of the drum, which is wider than the total of the components disposed in the excavating region of the cutting drum, except for the pick tips. In a specific construction the cutter bars at the rings holding together the ends of the drum, at their outer diameter are connected to conical sheet metal plates, the inner peripheral circles of which encompass parts of the discharge chute, conveying the material being mined from the cutter bar to an axial conveyor via the annular chute, and the outer peripheral circles of which approximate the cutting outlines at the end of the drum, and are protected against wear and tear by hard inserts. For example the hard inserts are discs of hard metal, soldered into slots cut into the outer peripheral circles of the conical sheet metal plates.

BRIEF DESCRIPTION OF THE DRAWINGS

The invention is elucidated in more detail in what follows by way of a working example and with reference to the drawings. There are shown in FIG. 1 is a side elevation of a cutting drum in section armed with cutting tools.

DESCRIPTION OF SPECIFIC EMBODIMENTS OF THE INVENTION

The following description of specific embodiments and the contents of the drawings as such, read in conjunction with the preceding more general description will enable the person skilled in the art to practise the invention as defined in the claims.

Figure 1:
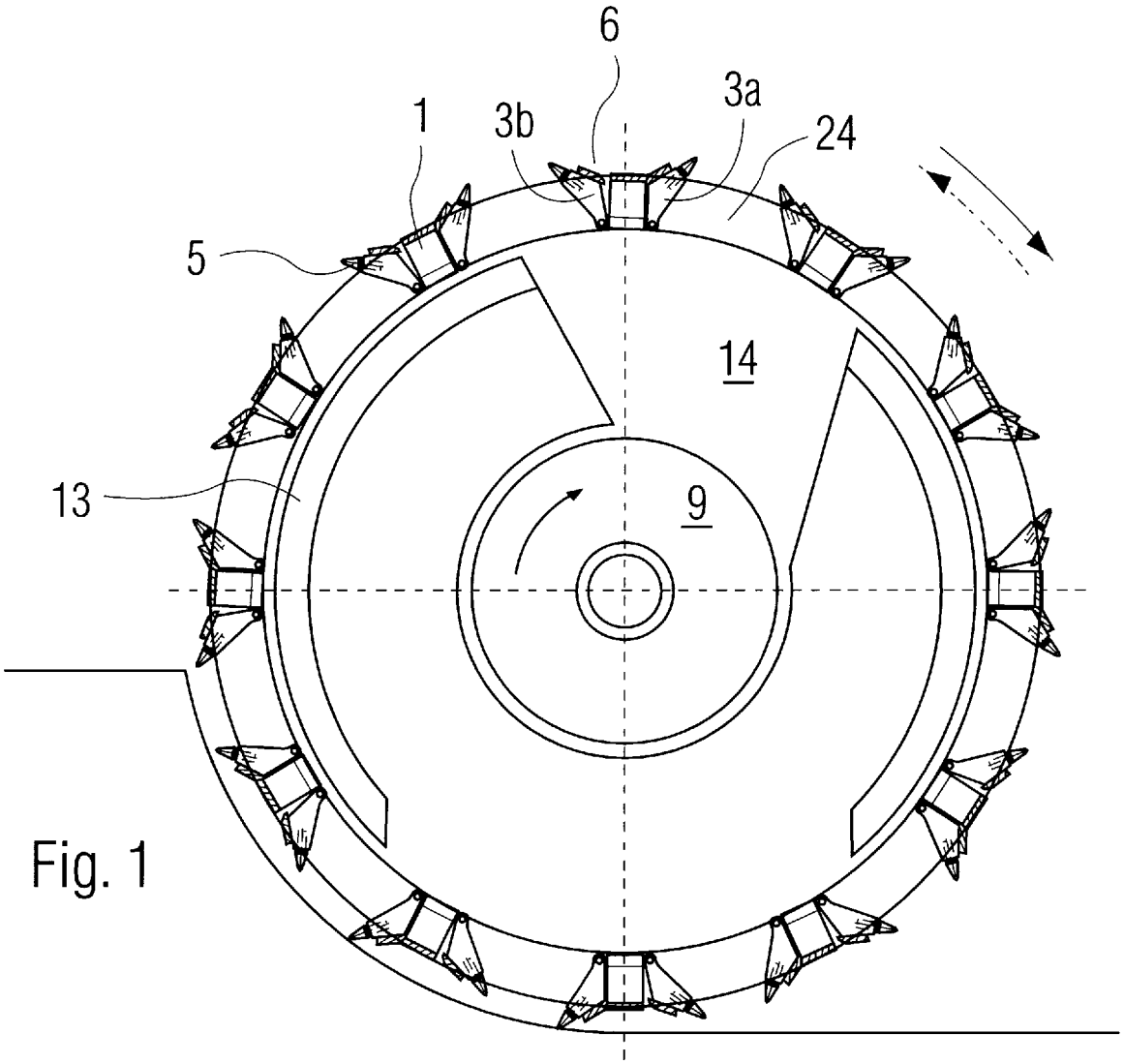

According to FIG. 1 the basic body of the cutting drum of an open pit mining winning apparatus performing its winning action in both directions of travel, automotive on a crawler type undercarriage, is formed by a latticed drum. This latticed drum consists of cutting bars 1 evenly spaced on the drum circumference and interconnected by rings 2. The cutter bars 1 are of rectangular cross-section and accommodate the cutting tools 3. These cutting tools 3 consist of the pick holders 4, the picks 5, the sheet metal scrapers 6, merging into blades 7 in the region of the pick tips and the contact surface 8.

Figure 5:
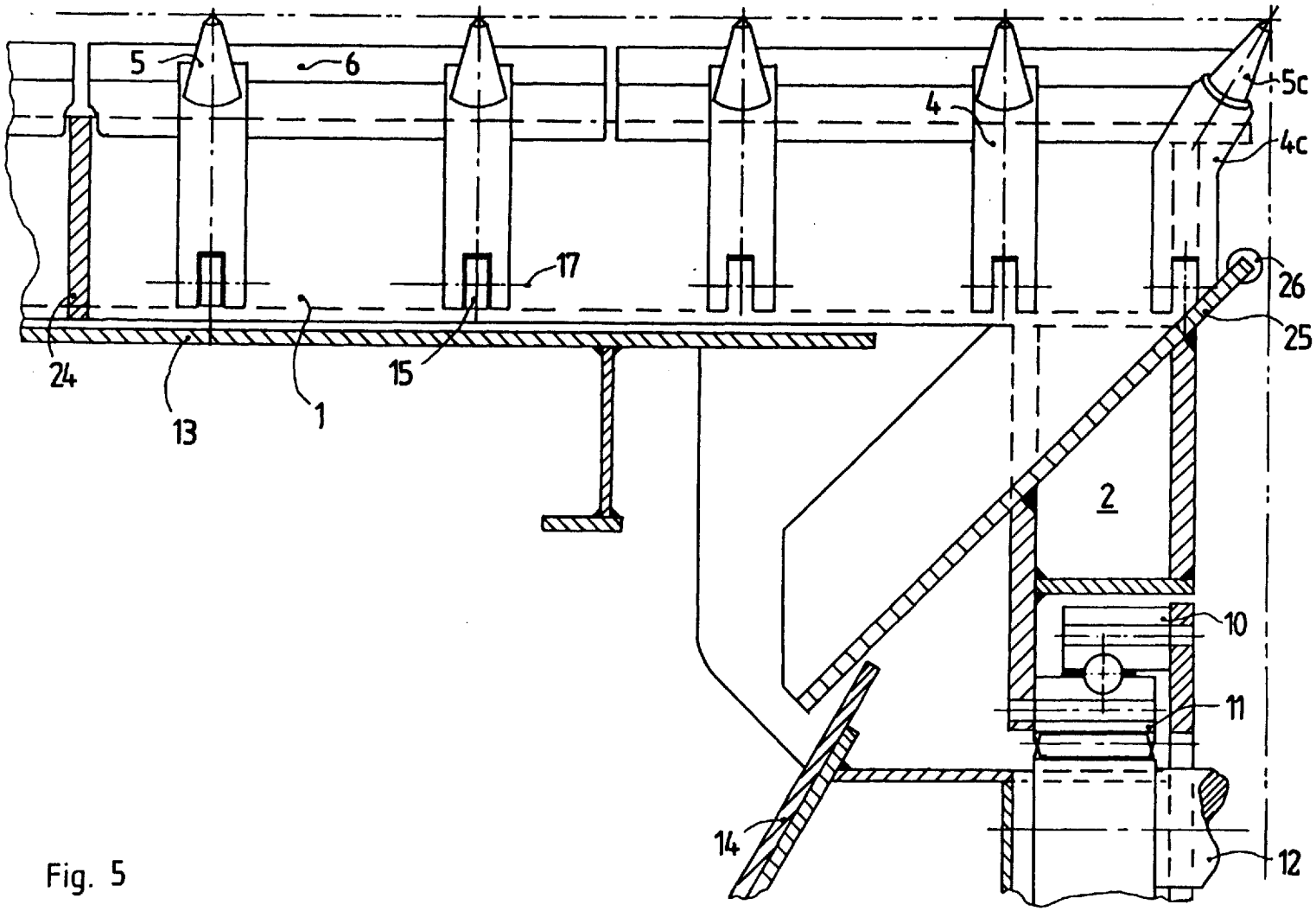
FIG. 5 is partially sectional view of the cutting drum circumference in the region of a face end and FIG. 6 is an enlarged perspective view of the edge protection according to FIG. 5.

According to FIG. 5 the basic structure of the cutting drum further includes the rings 9 terminating at the end face and comprising the ball bearings 10, and the toothed wheel rim 11 driven by the pinion 12. Inside the cutting drum the annular chute 13 as well as the discharge chute 14 are provided.

The cutting drum is able to operate productively in both directions of rotation. In FIG. 1 the momentary direction of rotation, duly observing the pick position resulting therefrom, is marked by an arrow pointing in the right-hand direction.

According to the working example, the design of the cutting tools 3 may be in accordance with two embodiments. The first embodiment according to FIG. 2 is at the same time the preferred embodiment while the second embodiment according to FIG. 3 represents a further constructional possibility of the special embodiment.

Both embodiments have in common that the cutter bars 1 comprise lugs 15 on the edges oriented towards the rotation center of the cutting drum. Each of the lugs 15 is provided with a bore 16, wherein the pick holders 4 by means of bolts 17 are held in an articulated manner. The pick holders 4 can pivot within a range of about 10°. The one terminal position which at the same time is the operational position of the cutting tool 3, is attained if, in embodiment 1, the pick holders 4 or in embodiment 2, the blade 7 by way of the contact surface 8 bear(s) against the cutter bar 1. The other terminal position is attained when the cutter tool 3 is at an angle projecting into the already excavated region. In the working example this position means that the pick holder 4 swings away from the cutter bar 1 by approximately 10°. As only one cutter tool 3*a* of a pair is in operational position (excavation position) at any one time, depending on the rotational direction of the cutting drum, while the other cutter tool 3*b* has to be swivelled into the already excavated position, a connection bar 18 is provided between both pick holders 4*a* and 4*b*. For fixing the cutter tools 3 of a pair 3*a* and 3*b* in the operational position, depending on the rotational direction, even when moving beyond the excavation region, a spring-loaded lever 19 comprising a roll 20 is disposed on one of the pick holders 4*a* or 4*b*, engaging a two-stage latching means 21 provided on the outer surface of the cutter bar 1.

Figure 2:
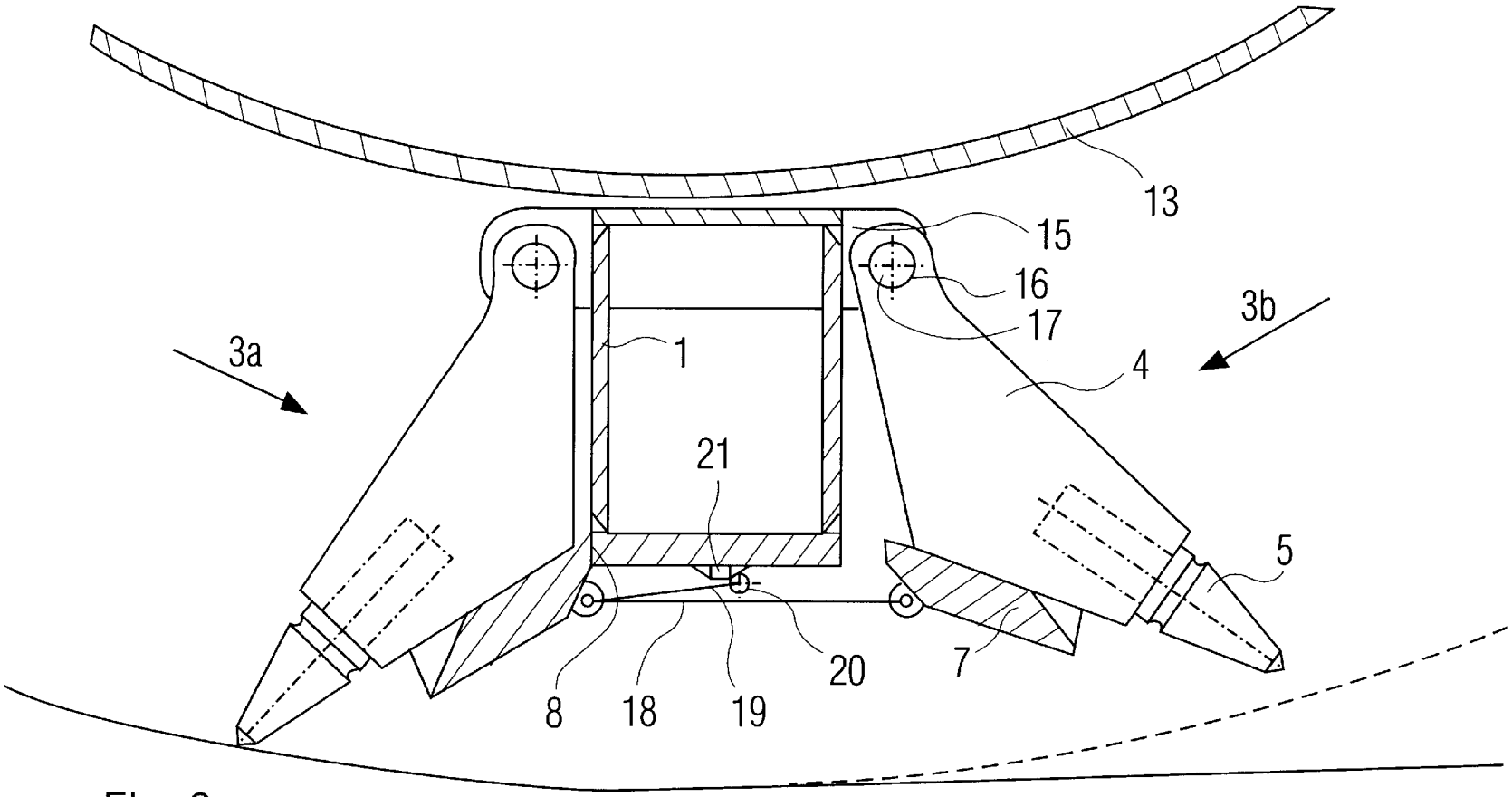
FIG. 2 is a side elevation of a cutter bar in section comprising a cutter tool provided thereon according to embodiment 1.
Figure 3:
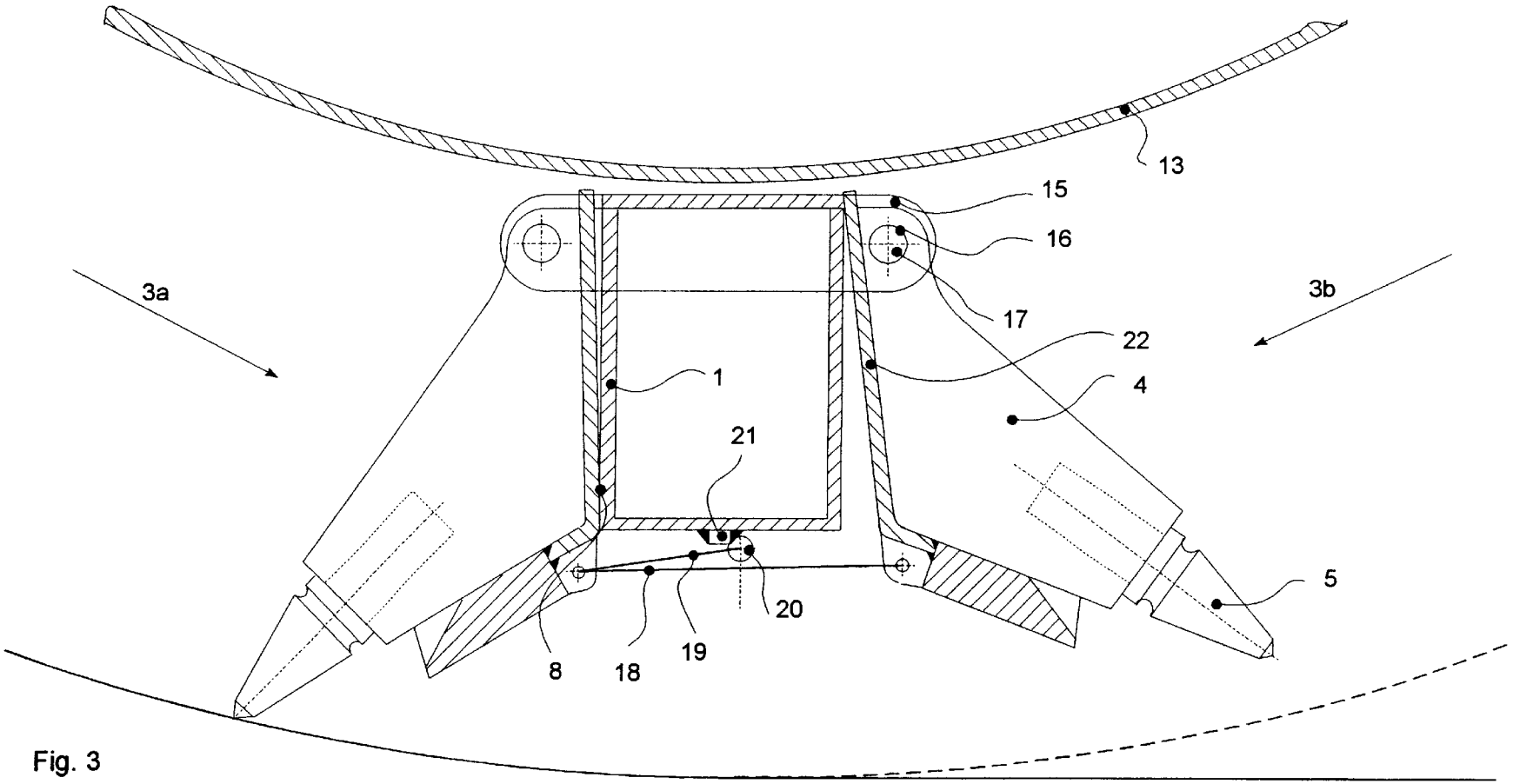
FIG. 3 is a side elevation of a cutter bar in section comprising a cutter tool provided thereon according to embodiment 2.

The cutter tools 3 of both embodiments according to FIGS. 2 and 3 differ from one another in that in the preferred embodiment according to FIG. 2 the contact surface 8 in relation to the cutter bar 1 is kept very small so as to avoid build-up of conveyed material caught there between causing possible operational malfunctions. The embodiment according to FIG. 3 comprises a backing plate of sheet metal connecting the pick holders 4 and bearing against the cutter bar 1 in the operating position. This solution offers better rigidity but may in practice result in operational malfunctions, should the material to be mined be inclined to build-up on the surfaces of the cutter bars 1 and the backing plate of sheet metal 22.

Figure 4:
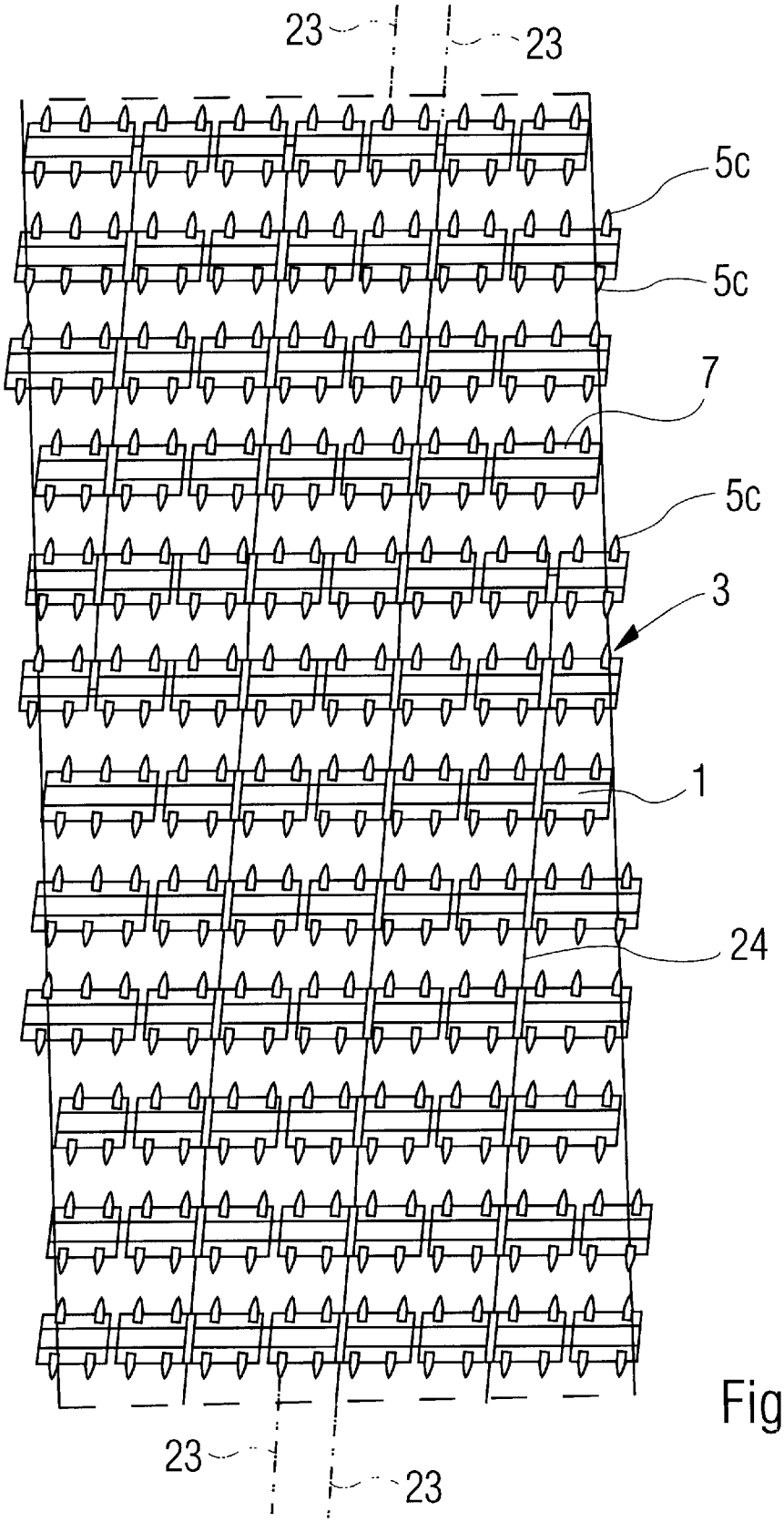
FIG. 4 is a view of the disposition of the cutting tools on the circumference of a cutting drum, illustrated in developed form.

Both cutters 5*c*, each provided at the end of one of a helical line 23 connecting the pick tips and intended to cut free the end faces of the cutting drum, are fitted to the pick holders 4*c*, deflected sideways at right angles as shown in FIG. 5. Each cutter tool 3 includes two or more pick holders 4 armed with picks 5. On each of the cutter bars 1 extending over the entire width of the cutting drum and provided preferably parallel to the rotational axis of the cutting drum, the cutter tools 3 are so disposed that the picks 5 are evenly distributed. The invention provides that the cutter tools 3 be designed to include two or more pick holders 4 and picks 5. In the working example according to FIG. 4 cutter tools 3 comprising two and three pick holders 4 are provided. From this illustration it is further readily apparent that the pick holders 4 on opposite sides of each cutter bar 1, are interconnected in an articulated manner by one or a plurality of connecting bars 18. The length of these connecting bars 18 is so chosen that, in the event of the cutter tool 3*a* performing excavation work bearing against the cutter bar 1, the opposite cutter tool 3*b* is raised to such an extent that its picks 5 are within the cut-free outlines. This is the case when raised by about 10° (FIGS. 2 and 3).

The bars 24, each disposed centrally between two rows of picks 5, interconnect the cutter bars 1 rigidly and likewise form helical lines 23.

The blades 7 illustrated in FIGS. 2 and 3 may be advanced more or less closely to the cutting orbit defined by the pick tips, depending on the extent to which they are to participate in the excavation work. In the case of coalescing strata, the blades 7 may be advanced very closely to the cutting orbit. In the case of very easily excavated strata, picks 5 may be dispensed with altogether, the blades 7 performing the excavating task on their own. In very hard rock a gap, as illustrated in FIGS. 2 and 3, is provided between the cutting orbit and the blade 7. This causes the blades 7 to break only the ridges remaining between the grooves (cut in the rock by the picks 5) and to pick up most of the loosened material to be mined. A small remainder, a few centimetres thick, is left on the ground and is picked up during the next winning trip.

Figure 6:
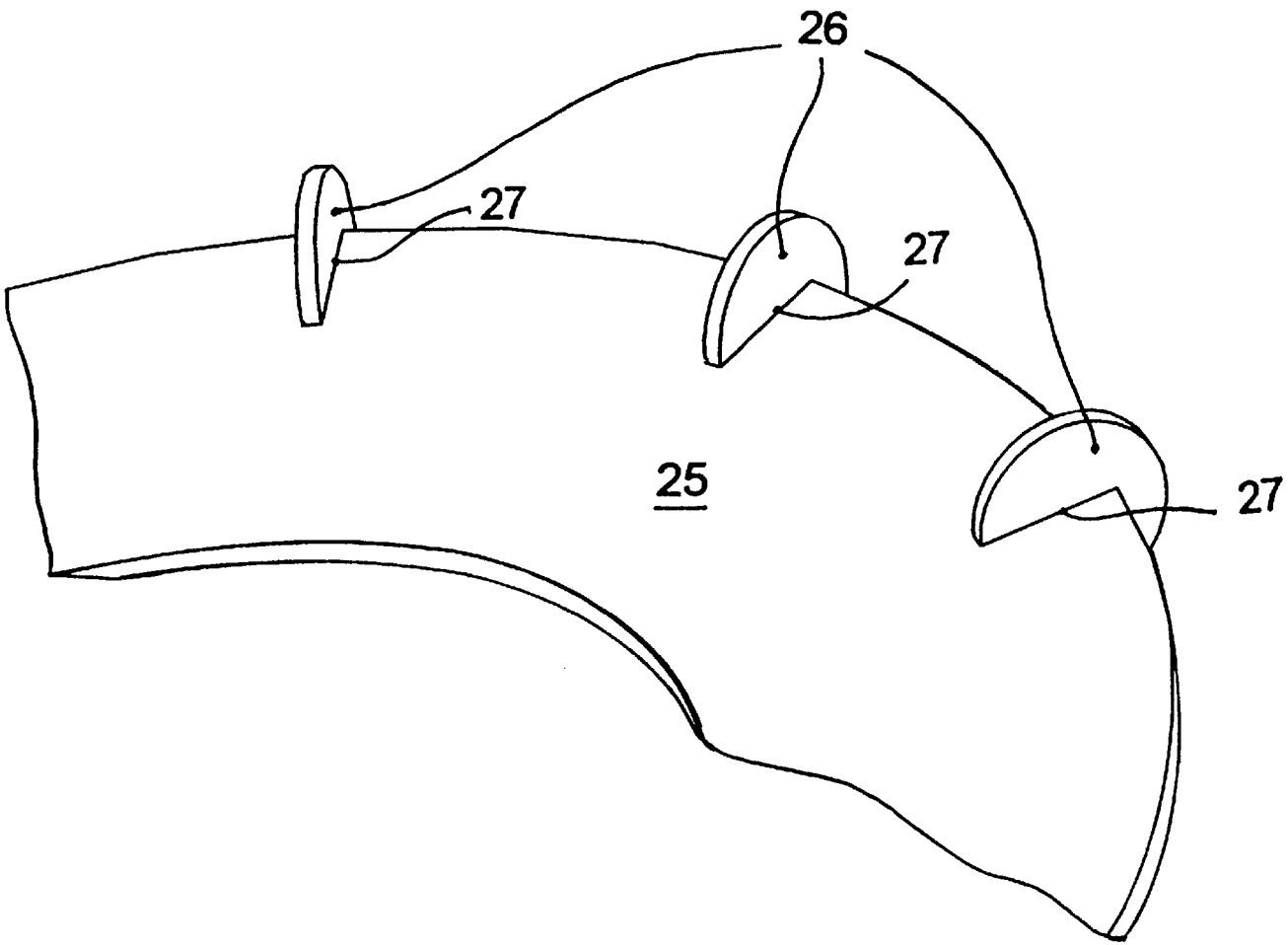

Conical sheet metal plates 25 form part of the basic structure of the cutting drum according to FIG. 5. Their end facing outer edges are particularly subjected to wear and tear during mining. Special edge protection is therefore provided. According to FIG. 6 slots 27 are cut into the conical sheet metal plates 25. Into these slots 27 hard metal discs 26 are soldered. This edge protection as well as the picks 4*c* of deflected configuration, ensure that during excavation favourable conditions exist even at the far ends of the cutting drum.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A milling roller for a self-propelled mining device performing mining in both directions of travel for strip mining, the milling roller comprising:

milling tools;

a ring;

cutter bars on the milling roller circumferential surface said cutter bars being connected to one another in a circumferential direction by said ring and carrying said milling tools, each milling tool including bits with bit holders, said bit holders being mounted tiltably around an axis of rotation for automatic tilting such that bits pointing in a direction of rotation are automatically pivoted into a milling position by the digging resistance during engagement with the material to be mined, and that the bits directed in the opposite direction are at the same time pivoted out of the range of the free-cutting angle of the bits performing the digging operation, one of said bit holders being positioned for milling operation with rotation to the right and another bit holder of said pair being positioned for milling operation with rotation to the left, arranged on both sides of a said cutter bar in a hinge-like manner, said bit holders being connected by carrier plates, said bits being interchangeable bits fastened to said bit holders, said carrier plates including blades in an area of tips of said bits;

connection bars between said milling tools, said connection bars being arranged opposite said cutter bar for effecting said automatic tilting; and catches provided at said connection bars for fixing said bits in the respective digging position or free-cutting position with a force that is strong enough to prevent said bit holders from tilting under their own weight during rotation of the milling roller, whereby at the time of a change in the direction of milling, said bits of one cutter bar side are moved upon contact, of said bits of said one cutter bar side and an associated said blade, with the mineral to be separated against the force of said catches and opposite bits are pivoted into the free-cutting position.

2. The milling roller in accordance with claim 1, wherein said cutter bars are arranged in an axial direction.

3. The milling roller in accordance with claim 1, wherein said cutter bars are arranged obliquely on said circumferential surface.

4. The milling roller in accordance with claim 1, wherein said cutter bars are arranged in a shape of arrows on said circumferential surface.

5. The milling roller for in accordance with claim 1, wherein said cutter bars are connected by said connection bars, said connection bars being arranged approximately in the circumferential direction and having inner and outer limitations approximately corresponding to inner and outer limitations of said cutter bars.

6. The milling roller in accordance with claim 1, wherein said bits are distributed along helical lines over a circumference of the milling roller.

7. The milling roller in accordance with claim 6, wherein said connection bars are arranged along helical lines extending approximately in a middle between two said adjacent helical lines each of the said bits.

8. The milling roller in accordance with claim 1, wherein said bits are one of round bits, flat bits or spade bits.

9. The milling roller in accordance with claim 1, wherein said bit holder has a back which is in contact with said cutter bar over only a small contact surface in a working position, and said contact surface is located at the greatest possible distance from the hinge.

10. The milling roller in accordance with claim 1, wherein the milling tools are supported on said cutter bars only with rear sides of said blades.

11. The milling roller in accordance with claim 1, wherein outermost bit holders, arranged in the area of the front sides of the roller, are bent at right angles such that associated said bits, projecting on the front side of the roller, cut free a roller contour that is greater than all the parts arranged in the range of digging of the milling roller except for the tips of the bits.

12. The milling roller in accordance with claim 1, further comprising: inserted wear protection hard parts; conical plates; an axial conveyor; and a discharge chute, wherein said cutter bars are connected to said conical plates at said ring holding together front sides of the milling roller at an outer diameter, and inner limiting circles of said conical plates surround parts of said discharge chute, through which they guide the material being conveyed from said cutter bars to an axial conveyor via said ring chute, and whose outer limiting circles reach to an area close to the roller front-side cutting contour and are protected from wear by said inserted hard parts.

13. The milling roller in accordance with claim 12, wherein said hard parts are disks made of hard metal, said disk being soldered in slots cut within the outer limiting circles of said conical plates.

* * * * *